US011484139B1

(12) United States Patent
Hagberg

(10) Patent No.: US 11,484,139 B1
(45) Date of Patent: Nov. 1, 2022

(54) COMBINATION COAT HANGER AND GUN RACK

(71) Applicant: Michael Evert Hagberg, Battle Ground, WA (US)

(72) Inventor: Michael Evert Hagberg, Battle Ground, WA (US)

( * ) Notice: Subject to any disclaimer, the term of this patent is extended or adjusted under 35 U.S.C. 154(b) by 0 days.

(21) Appl. No.: 17/735,078

(22) Filed: May 2, 2022

Related U.S. Application Data

(60) Provisional application No. 63/220,680, filed on Jul. 12, 2021.

(51) Int. Cl.
*A47G 25/06* (2006.01)
*F41A 23/18* (2006.01)

(52) U.S. Cl.
CPC ..... *A47G 25/0692* (2013.01); *F41A 23/18* (2013.01)

(58) Field of Classification Search
CPC ..... B60R 9/02; B60R 7/00; B60R 7/14; F41C 33/003; F41C 33/005; A47B 81/005; F41A 23/18; A47G 25/0692
See application file for complete search history.

(56) References Cited

U.S. PATENT DOCUMENTS 2,158,623 A * 5/1939 Fischbacher ..... A47B 81/005 211/180
3,917,071 A * 11/1975 Walters ..... E05B 73/00 248/553
4,209,157 A 6/1980 Edmisten
4,852,780 A * 8/1989 Woodbury ..... B60R 7/14 224/571
4,936,531 A * 6/1990 Bauser ..... B60N 3/00 248/125.3
5,078,309 A * 1/1992 Hull ..... B60R 21/026 224/571
6,834,454 B2 * 12/2004 Klein ..... B60R 7/14 42/70.11
7,137,511 B1 * 11/2006 Crowell ..... F41A 23/18 248/176.1
9,345,322 B1 * 5/2016 Starnes ..... A47G 25/14
9,366,501 B2 * 6/2016 Visalli ..... F41C 33/0227
10,144,358 B2 * 12/2018 Fife ..... A47F 5/08
10,882,458 B2 * 1/2021 Laborde, Jr. ..... F41C 33/005
11,110,867 B2 * 9/2021 Franklin ..... A47F 7/0028
11,326,851 B1 * 5/2022 Oldham ..... A47B 81/005

* cited by examiner

*Primary Examiner* — Ko H Chan
(74) *Attorney, Agent, or Firm* — QuickPatents, LLC; Kevin Prince

(57) ABSTRACT

A storage assembly can hang clothing items while providing for adjustable storage for a long gun and/or one or more pistols. The storage assembly includes a main arm having a plurality of holes formed therethrough with a hanging member disposed on a first end of the main arm. An extension arm can telescopingly extend from and be adjustably attached to an open bottom end of the main arm. An upper securing device is adjustably positioned along a length of the front of the main arm. A lower base member is disposed at the front of the distal end of the extension arm. The lower base member can support the stock of a long gun, while the upper securing device can attach to the barrel of the long gun. One or more pistol holders can be placed adjustably along the back side of the main arm.

15 Claims, 12 Drawing Sheets

COMBINATION COAT HANGER AND GUN RACK

CROSS-REFERENCE TO RELATED APPLICATIONS

This application claims the benefit of U.S. Provisional Patent Application 63/220,680, filed on Jul. 12, 2021, and is incorporated herein by reference.

STATEMENT REGARDING FEDERALLY SPONSORED RESEARCH AND DEVELOPMENT

Not Applicable.

FIELD OF THE INVENTION

This invention relates to storage solutions, and more particularly to a coat hanger combined with an adjustable gun rack.

BACKGROUND

To store pistols and/or long guns, a user has limited options. Various gun cases and cabinets are available to store items, but such cases and cabinets can be expensive, heavy and may require additional steps to retrieve the item. Also, someone breaking into a home may easily recognize a gun safe or case and desire to take such a high value item, safe/case and all.

Further, it is often desirable to store guns in such a manner to provide ready access to a user. However, such places may be difficult to lock to secure the weapon and may not provide adequate concealment that may be desired by a user.

Therefore, there is a need for a device that can store a long gun and/or a pistol, while concealing the weapons and providing for a quick and easy means to secure the stored weapons while permitting for quick and easy access to a user. The present invention accomplishes these objectives.

SUMMARY OF THE INVENTION

The present device is a storage assembly that can hang a clothing item while providing for adjustable storage for a long gun and/or one or more pistols. The storage assembly includes a main arm having a plurality of holes formed therethrough; a hanging member disposed on a first end of the main arm; an extension arm, having a plurality of extension arm holes, telescopingly extendable from an open bottom end of the main arm, the extension arm having a proximate end insertable into the open bottom end of the main arm and a distal end extending out of the open bottom end. An upper securing device is adjustably positioned along a length of the main arm and extends from a front side of the main arm. A lower base member is disposed at the distal end of the extension arm and extends from a front side of the extension arm. The lower base member can support the stock of a long gun, while the upper securing device can retain the barrel of the long gun.

The storage assembly can further include one or more pistol holders, operable to have a pistol secured thereto, adjustably attached along a length of the main arm. In some embodiments, the pistol holder includes an elongated post extending from a base of the pistol holder, the elongated post operable to be inserted into a barrel of a pistol. In some embodiments, the pistol holder retains the pistol behind a rear surface of the main arm. In some embodiments, the pistol holder is adjustably positioned along a length of the main arm at one of the plurality of holes.

The hanging member of the storage assembly can be a hanger operable to hold a clothing item, the hanger having a hook disposed between two extending arms, with the main arm extending below the extending arms, opposite the hook. The clothing item, such as a shirt or jacket, for example, may help conceal the long gun and/or pistol(s) placed in the storage assembly.

The present invention can provide a hanger for hanging a clothing item that can also secure a long gun, a pistol, or the like. The clothing item can provide for concealment of the weapon, while permitting the user quick and easy access thereto. Further, the hanging item may be placed into a closet that may have, for example, a locking door, thereby providing for proper storage in a quick and easy manner, should such be necessary.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
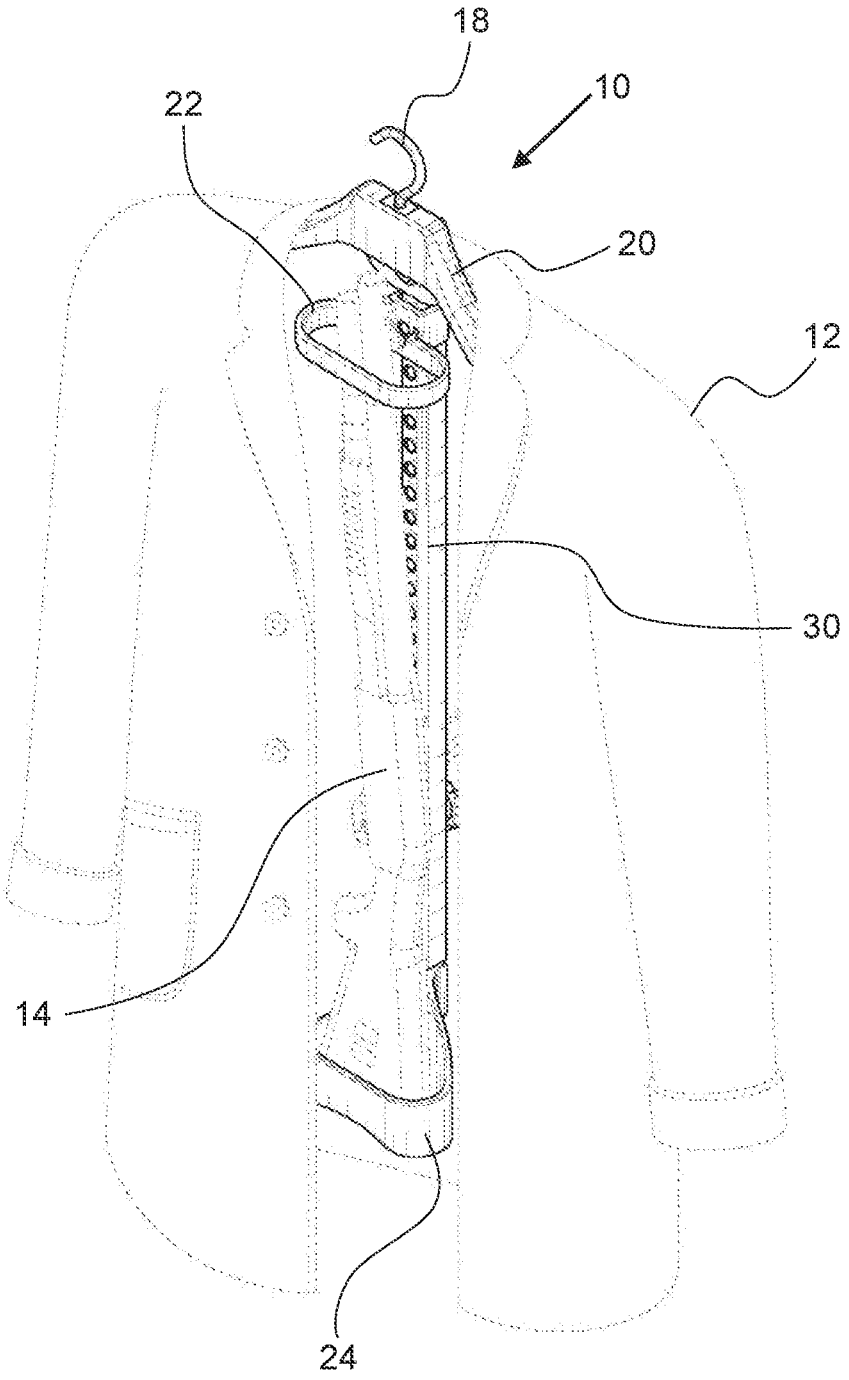
FIG. 1 is front perspective view of a coat hanger combined with an adjustable gun rack according to an exemplary embodiment of the present invention.
Figure 2:
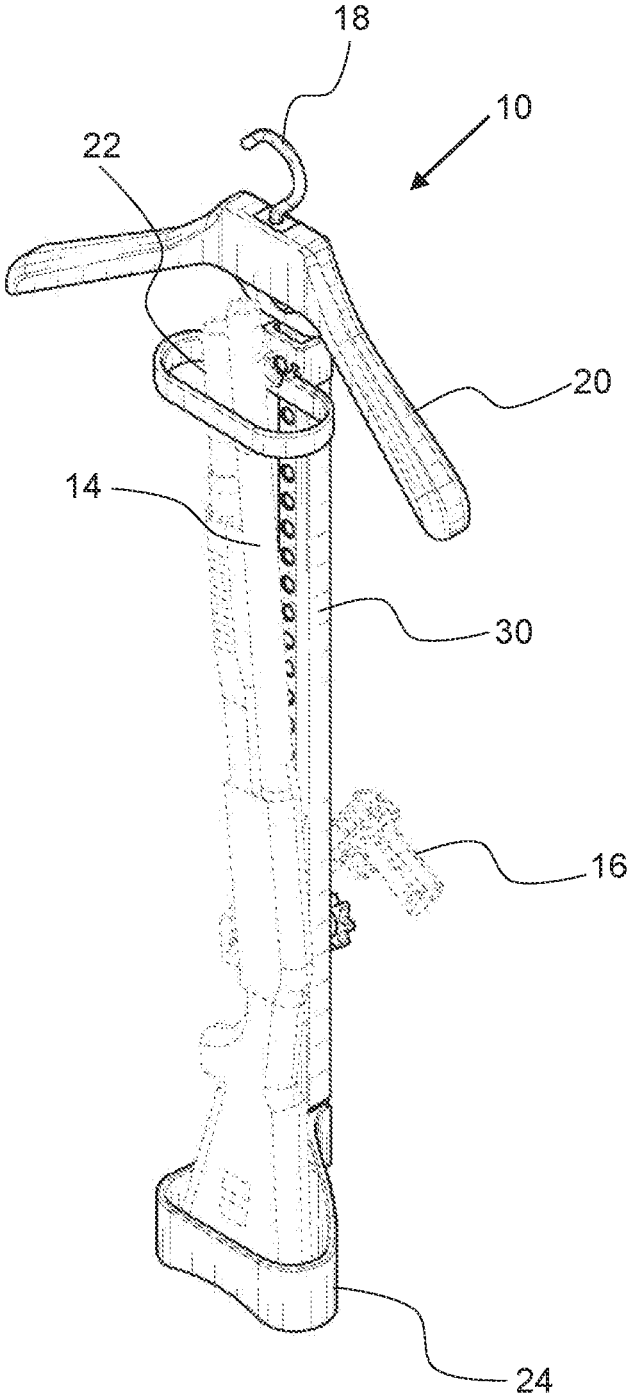
FIG. 2 is a perspective view of the coat hanger combined with an adjustable gun rack of FIG. 1 with the jacket removed for clarity.
Figure 3:
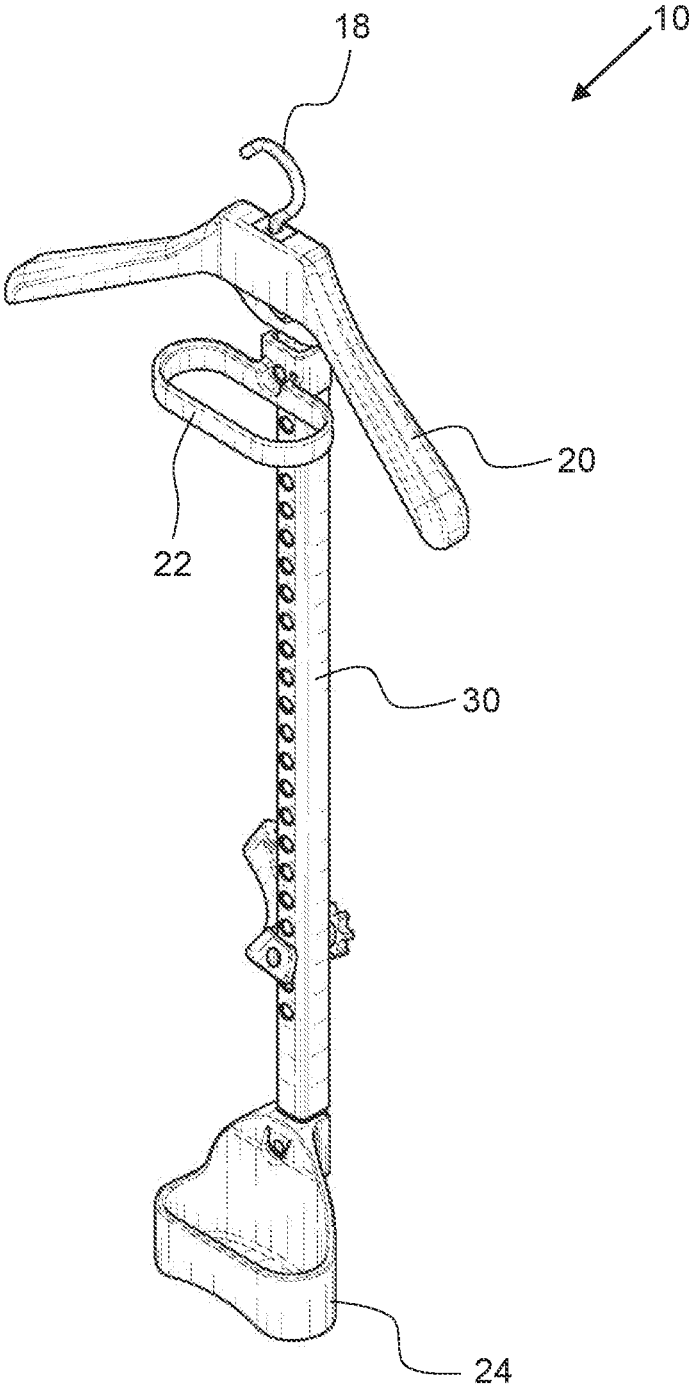
FIG. 3 is a perspective view of the coat hanger combined with an adjustable gun rack of FIG. 1 with the long gun and pistol removed.
Figure 4:
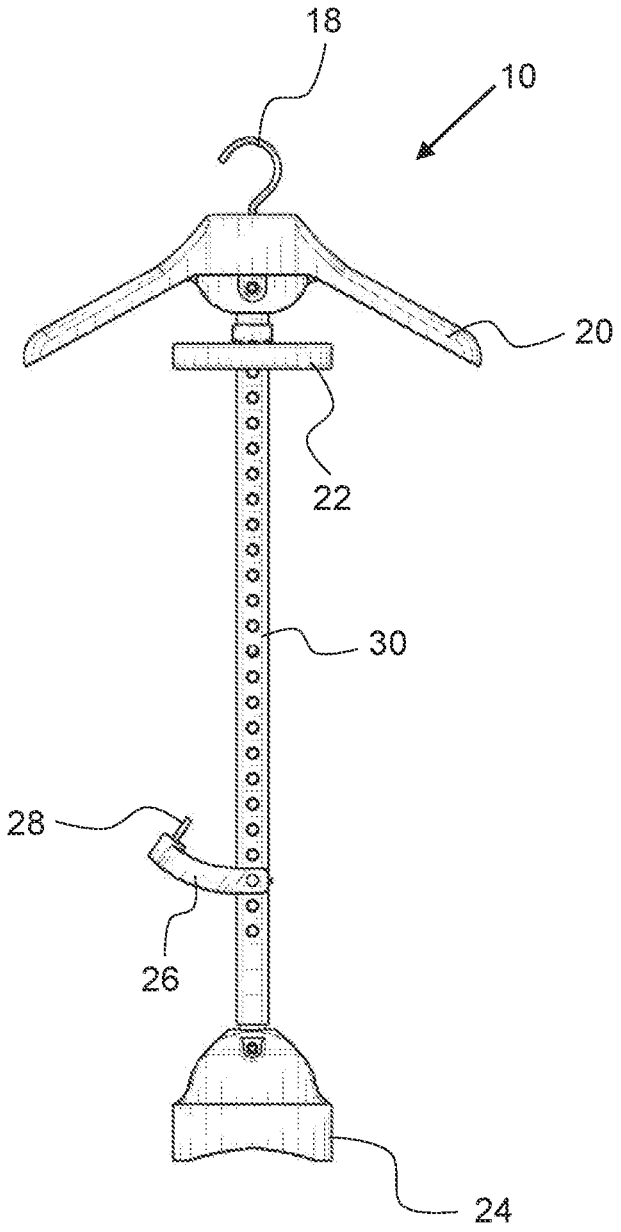
FIG. 4 is a front view of the coat hanger combined with an adjustable gun rack of FIG. 1.
Figure 5:
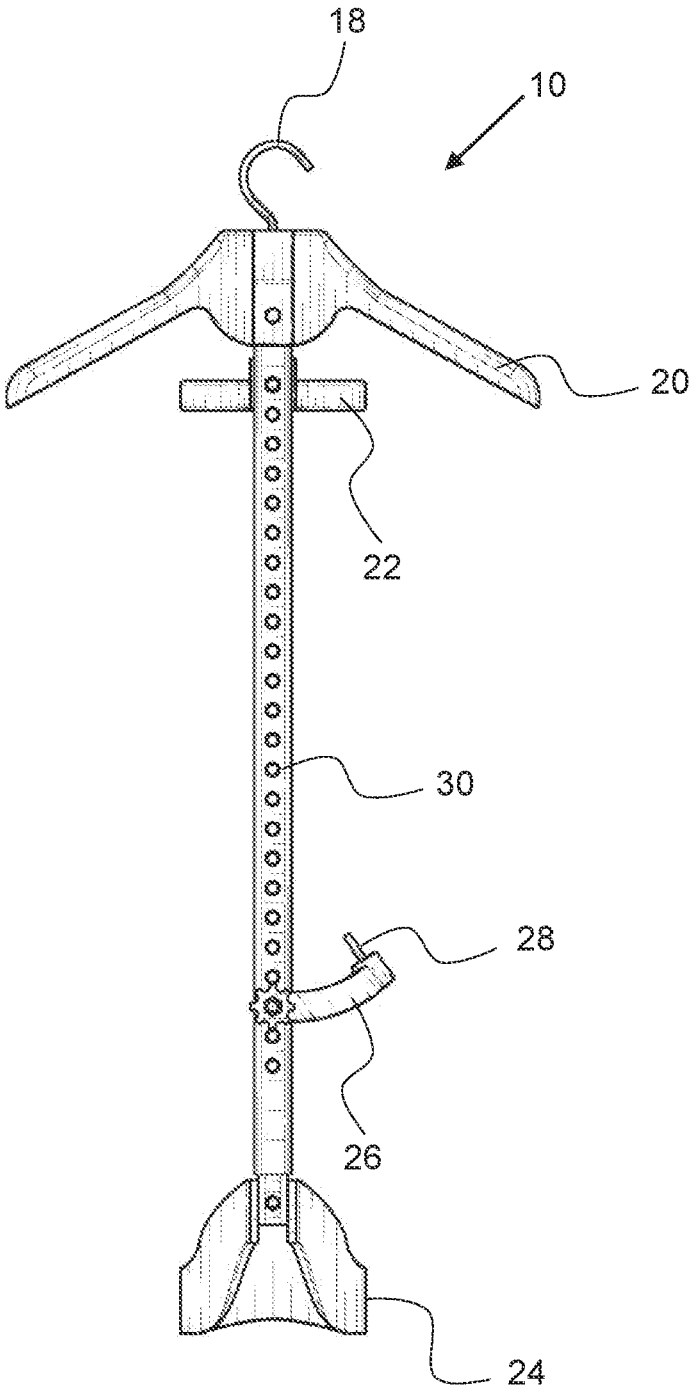
FIG. 5 is a back view of the coat hanger combined with an adjustable gun rack of FIG. 1.
Figure 6:
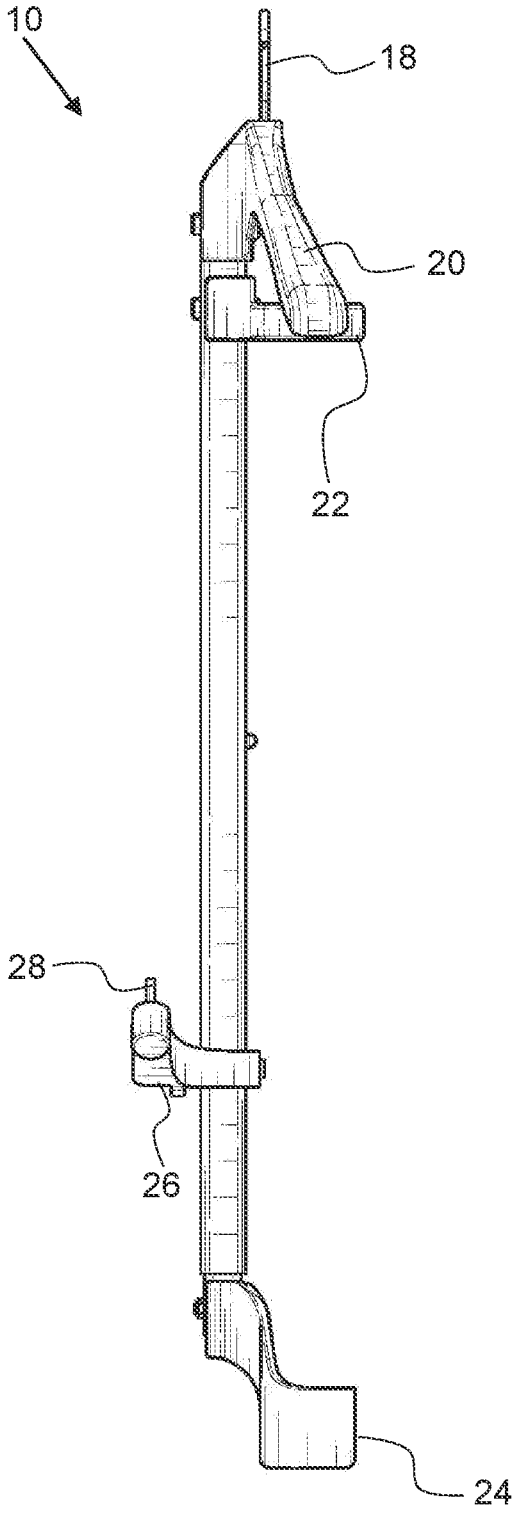
FIG. 6 is a left side view of the coat hanger combined with an adjustable gun rack of FIG. 1.
Figure 7:
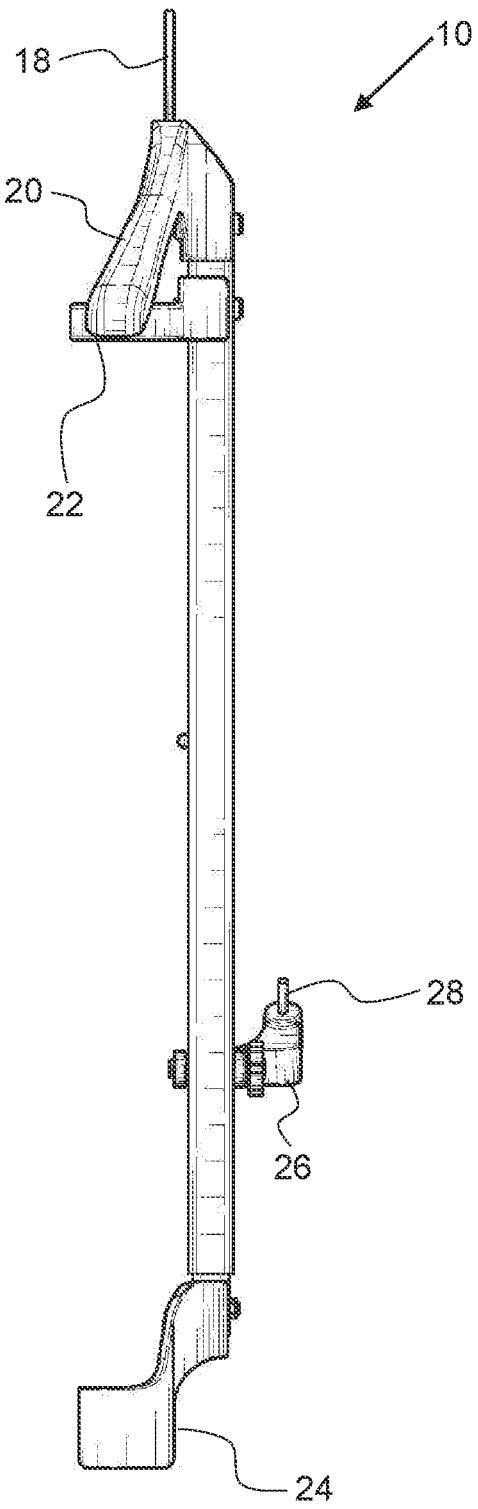
FIG. 7 is a right side view of the coat hanger combined with an adjustable gun rack of FIG. 1.
Figure 8:
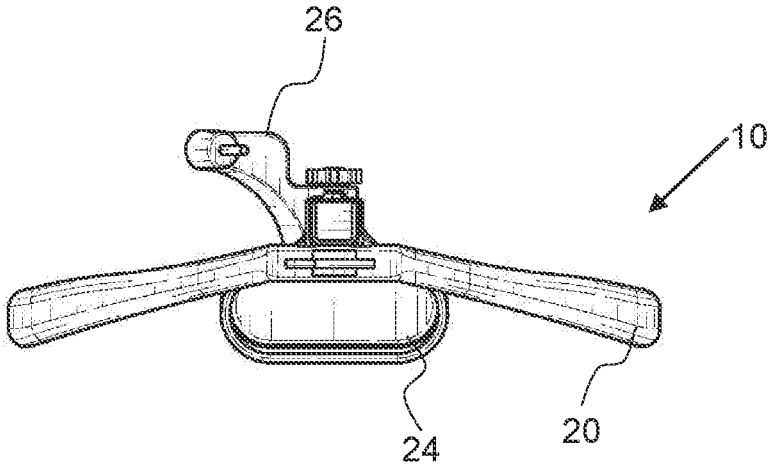
FIG. 8 is a top view of the coat hanger combined with an adjustable gun rack of FIG. 1.
Figure 9:
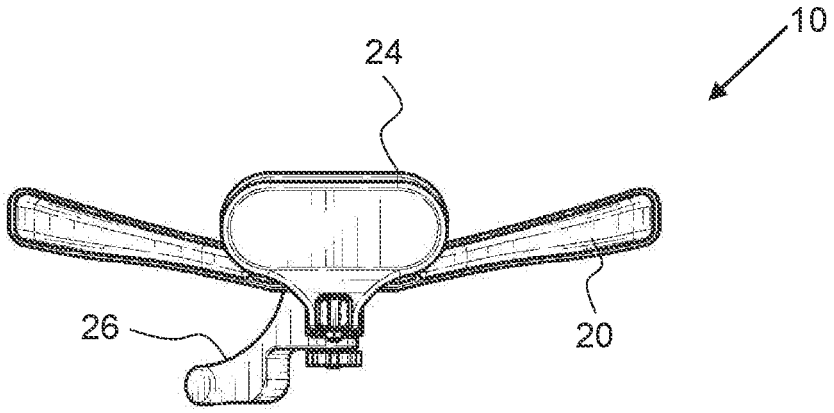
FIG. 9 is a bottom view of the coat hanger combined with an adjustable gun rack of FIG. 1.
Figure 10:
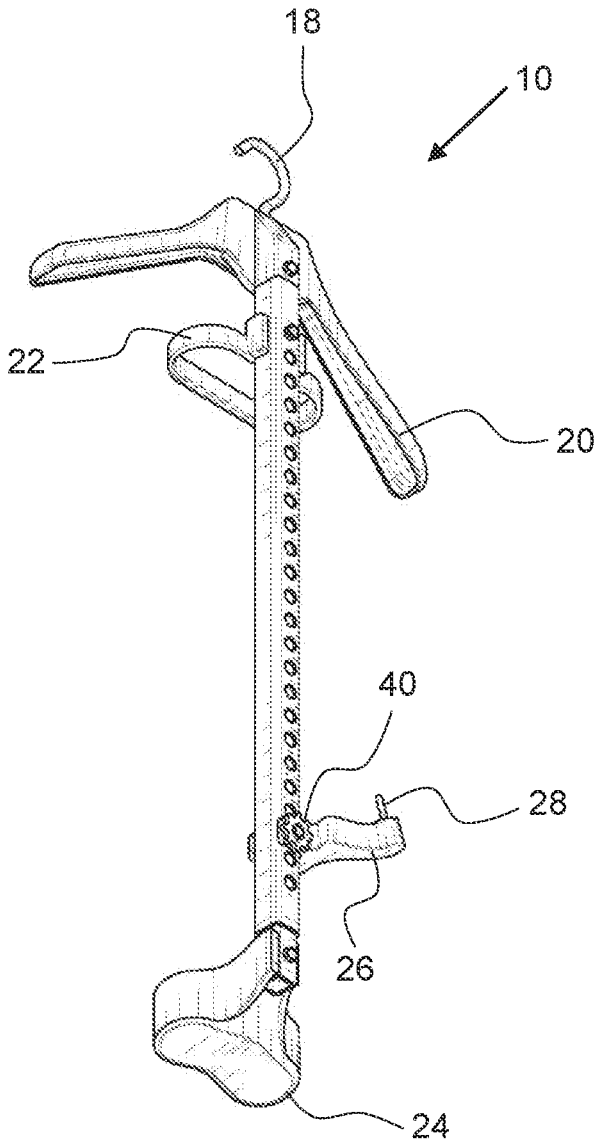
FIG. 10 is a back, bottom perspective view of the coat hanger combined with an adjustable gun rack of FIG. 1.
Figure 11:
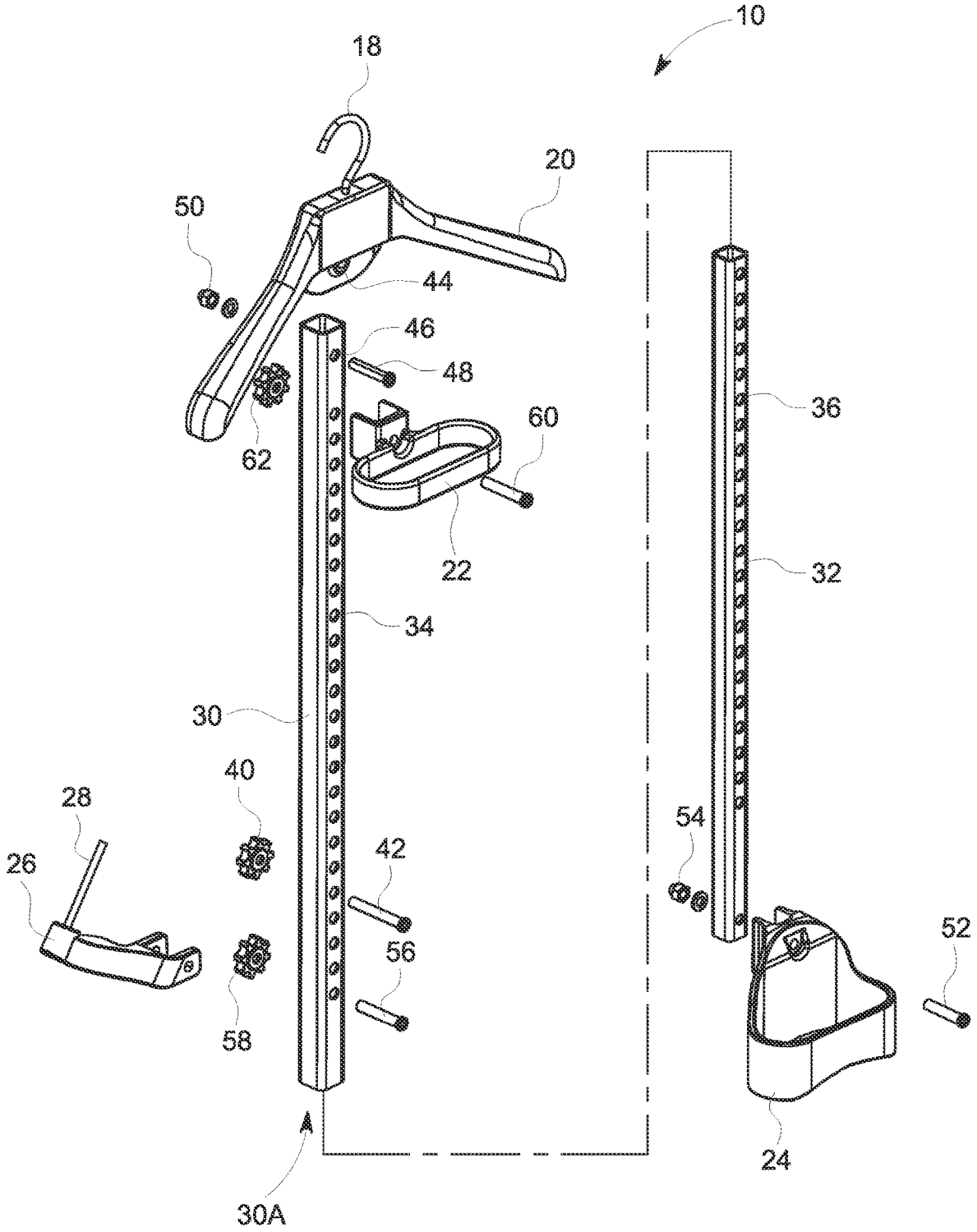
FIG. 11 is an exploded perspective view of the coat hanger combined with an adjustable gun rack of FIG. 1.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Broadly, embodiments of present invention provides a storage assembly that can hang a clothing item while providing for adjustable storage for a long gun and/or one or more pistols. The storage assembly includes a main arm having a plurality of holes formed therethrough with a hanging member disposed on a first end of the main arm. An extension arm can telescopingly extend from and be adjustably attached to an open bottom end of the main arm. An upper securing device is adjustably positioned along a length of the main arm and extends from a front side of the main arm. A lower base member is disposed at the distal end of the extension arm and extends from a front side of the extension arm. The lower base member can support the stock of a long gun, while the upper securing device can attach to the barrel of the long gun. One or more pistol holders can be placed adjustably along the back side of the main arm.

Referring to FIGS. 1 through 11, a storage assembly 10 comprises a main arm 30 having a plurality of holes 34 formed therethrough. A hanging member 18, 20 can be disposed on a first end of the main arm 30. An extension arm 32, having a plurality of extension arm holes 36, can be telescopingly extendable from an open bottom end 30A of the main arm 30, where the extension arm 32 has a proximate end insertable into the open bottom end 30A of the main arm 30 and a distal end extending out of the open bottom end 30. An elongated member, such as a bolt 42 can extend through one of the plurality of holes 34 in the main arm 30 while extending through one of the plurality of holes 36 in the extension arm 32, thus securing the relative position of the main arm 30 and the extension arm 32. A nut 40 can be disposed on the end of the bolt 42 once the proper amount of extension is determined. The nut 42 may be an oversized nut, as shown, to help permit each removal to adjust the length of the storage device 10. The pistol holder 26, as discussed below, may be secured to the main arm 30 with a bolt 56 and nut 58. Depending on the position of the pistol holder 26 along the main arm 30, the bolt 56 may also help secure the extension arm 32 to the main arm 30.

Figure 12:
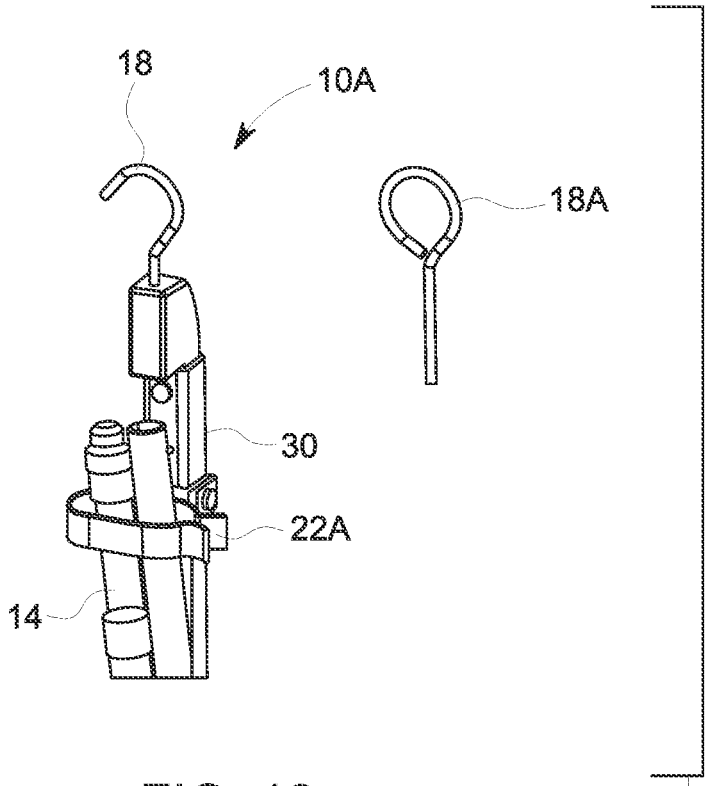
FIG. 12 is a partial view of the gun rack of the coat hanger combined with an adjustable gun rack of FIG. 1, illustrating an alternate holder for the long gun barrel and a different hanging hook, according to an exemplary embodiment of the present invention.
Figure 13:
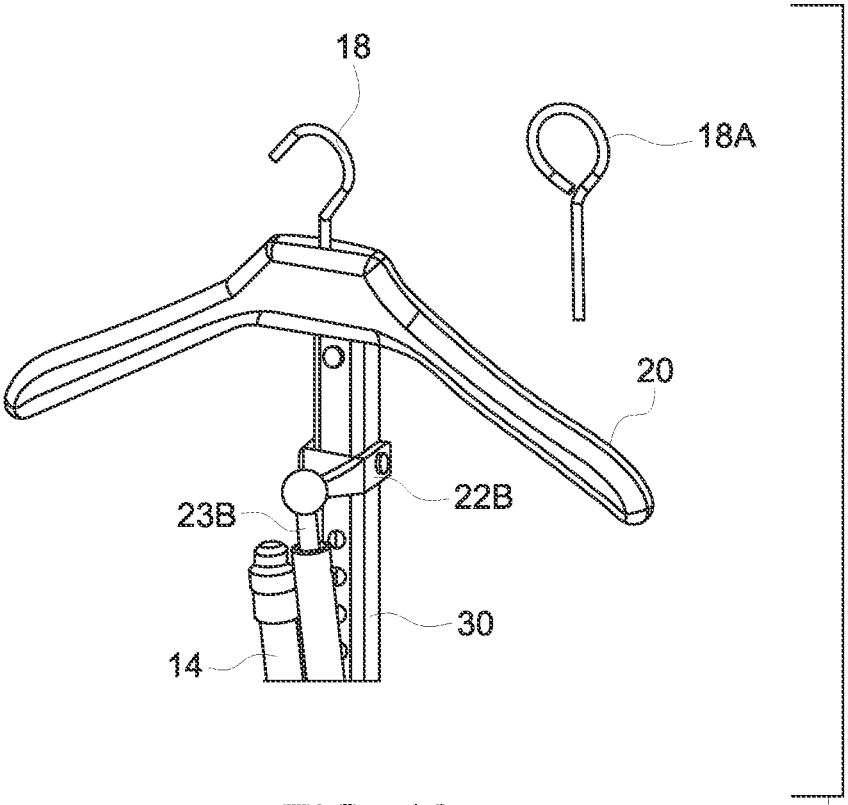
FIG. 13 is a partial view of the gun rack of the coat hanger combined with an adjustable gun rack of FIG. 1, illustrating an alternate holder for the long gun barrel and a different hanging hook, according to an exemplary embodiment of the present invention.
Figure 14:
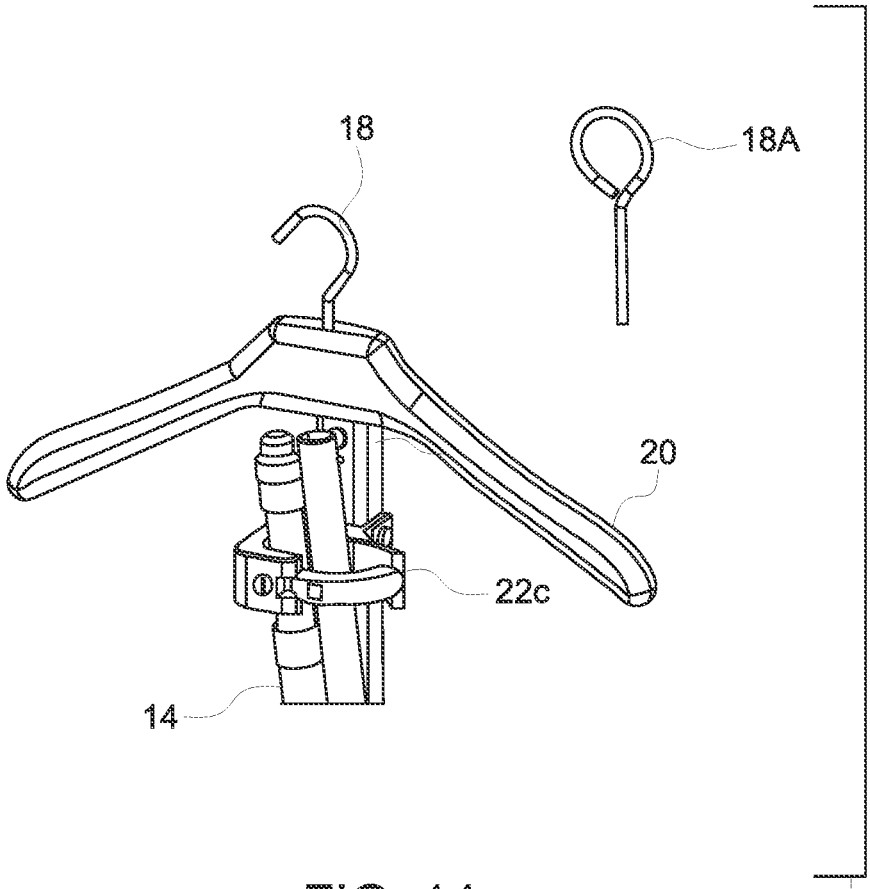
FIG. 14 is a partial view of the gun rack of the coat hanger combined with an adjustable gun rack of FIG. 1, illustrating an alternate holder for the long gun barrel and a different hanging hook, according to an exemplary embodiment of the present invention.

An upper securing device 22 can be adjustably positioned along a length of the main arm 30. A bolt 60 and nut 62 may be used to secure the upper securing device 22 at one of the plurality of holes 34 in the main arm 30. Typically, the upper securing device 22 can extend from a front side of the main arm 30. The upper securing device 22 may provide a closed loop, however, other designs may be within the scope of the present invention, provided that the upper securing device 22 can secure the barrel of a long gun. FIG. 12 illustrates an alternate embodiment 10A of the upper securing device 22A, where an open loop is provided that may be resiliently opened to permit insertion of the barrel of the long gun 14. FIG. 13 illustrates an alternate embodiment 10B of the upper securing device 22B, where a pin 23B may extend downward from the upper securing device 22B for insertion of the barrel of the long gun 14 thereinto. FIG. 14 illustrates an alternate embodiment 10C of the upper securing device 22C, where a closable loop is provided that may be opened to permit insertion of the barrel of the long gun 14 and then locked closed into a closed loop.

A lower base member 24 can be disposed at the distal end of the extension arm 32. A bolt 52 and nut 54 may be used to secure the lower base member 24 at the lower/distal end of the extension arm 32. The nut 54 may be a regular nut, as the position of the lower base member 24 may be fixed at the lower end of the extension arm 32. Typically, the lower base member 24 extends from a front side of the extension arm 32 and is positioned directly below the upper securing device 22. The lower base member 24 can be formed as an open pocket having a base member, sides extending upward from the base member, and an open top end. The open top end can receive the stock of the long gun while the sides prevent the stock from sliding out of the lower base member 24.

A pistol holder 26, operable to have a pistol secured thereto, can be adjustably attached along a length of the main arm 30. While one pistol holder 26 is shown in the Figures, it should be understood that more than one such pistol holder may be provided.

The pistol holder 26 can include an elongated post 28 extending from a base of the pistol holder 26, the elongated post 28 can be inserted into a barrel of a pistol 16 to secure the pistol 16 in place. Typically, the pistol holder 26 retains the pistol behind a rear surface of the main arm 30. Typically, the pistol holder 23 is adjustably positioned along a length of the main arm 30 at one of the plurality of holes 34. Of course, other designs for the pistol holder 26 may be used. For example, in place of the elongated post 28, the base of the pistol holder 26 may include a hole for receiving the barrel of the pistol therein.

The hanging member may be a hanger operable to hold a clothing item 12, the hanger having a hook 18 disposed between two extending arms 20, where the main arm 30 extends below the extending arms 20, opposite the hook 18. As shown in FIGS. 12-14, the hook 18 may be replaced with a closed eye 18A, thus preventing the hanger from lifting off a hanging rod. Such a closed eye 18A may be helpful to secure the device while quickly removing a weapon therefrom. The hanger can include a hole 44 for connecting the hanger to the main arm 30 via a bolt 48 and a nut 50 inserted through an upper hole 46 of the main arm 30 and the hole 44 in the hanger.

While a particular form of the invention has been illustrated and described, it will be apparent that various modifications can be made without departing from the spirit and scope of the invention. For example, in place of the arms of the hanger to hand a coat, bars may be provided on the front and/or back side of the main arm to hand pants or other clothing items. Further, the extension arm may be removed, where the device is not adjustable in length, but the main arm has the lower basket at the bottom and an adjustable barrel holder. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A storage assembly comprising:

a main arm having a plurality of holes formed therethrough, each of the plurality of holes extending entirely through the main arm, providing passage from a front side of the main arm to a back side of the main arm;

a hanging member disposed on a first end of the main arm;

an extension arm, having a plurality of extension arm holes, telescopingly extendable from an open bottom end of the main arm, the extension arm having a proximate end insertable into the open bottom end of the main arm and a distal end extending out of the open bottom end;

an upper securing device adjustably positioned along a length of the main arm and extending from a front side of the main arm;

a lower base member disposed at the distal end of the extension arm and extending from a front side of the extension arm;

a pistol holder, operable to have a pistol secured thereto, adjustably attached along a length of the main arm, wherein the pistol holder includes an elongated post extending from a base of the pistol holder, the elongated post operable to fit into a barrel of a pistol; and the pistol holder is angled so that when the barrel of the pistol is fit onto the elongated post, the pistol extends, from a distal end of the barrel, toward the main arm and at least a portion of the pistol is positioned adjacent and behind the back side of the main arm.

2. The storage assembly of claim 1, wherein the pistol holder is adjustably positioned along a length of the main arm at one of the plurality of holes.

3. The storage assembly of claim 1, wherein the upper securing device is adjustably positioned along a length of the main arm at one of the plurality of holes.

4. The storage assembly of claim 1, wherein the hanging member is a hanger operable to hold a clothing item, the hanger having a hook disposed between two extending arms, the main arm extending below the extending arms, opposite the hook.

5. The storage assembly of claim 1, wherein the lower base member is formed as an open pocket having a base member, sides extending upward from the base member, and an open top end.

6. The storage assembly of claim 1, further comprising a removable pin operable to extend through one of the plurality of holes in the main arm and one of the plurality of extension arm holes to secure the extension arm to the main arm as a desired telescoping length.

7. The storage assembly of claim 1, wherein the upper securing device includes a solid loop disposed at the front side of the main arm.

8. The storage assembly of claim 1, wherein the upper securing device includes a partial loop, resiliently openable, disposed at the front side of the main arm.

9. The storage assembly of claim 1, wherein the upper securing device includes a user-closable loop disposed at the front side of the main arm.

10. The storage assembly of claim 1, wherein the upper securing device includes a downward projecting pin disposed at the front side of the main arm.

11. A storage assembly configured to store a long gun and a pistol, comprising:

a main arm having a plurality of holes formed therethrough each of the plurality of holes extending entirely through the main arm, providing passage from a front side of the main arm to a back side of the main arm;

a hanging member disposed on a first end of the main arm;

an extension arm, having a plurality of extension arm holes, telescopingly extendable from an open bottom end of the main arm, the extension arm having a proximate end insertable into the open bottom end of the main arm and a distal end extending out of the open bottom end;

an upper securing device adjustably positioned along a length of the main arm and extending from a front side of the main arm, the upper securing device operable to retain a barrel end of the long gun;

a lower base member disposed at the distal end of the extension arm and extending from a front side of the extension arm, the lower base member operable to permit a stock of the long gun to rest thereupon; and a pistol holder attached on at least one of the main arm or the extension arm, the pistol holder operable to secure a pistol thereto in a position behind a rear surface of the main arm or the extension arm, wherein the pistol holder includes an elongated post extending from a base of the pistol holder, the elongated post operable to fit into a barrel of a pistol; and the pistol holder is angled so that when the barrel of the pistol is fit onto the elongated post, the pistol extends, from a distal end of the barrel, toward the main arm and at least a portion of the pistol is positioned adjacent and behind the rear surface of the main arm.

12. The storage assembly of claim 11, wherein the lower base member is formed as an open pocket having a base member, sides extending upward from the base member, and an open top end.

13. The storage assembly of claim 11, wherein the hanging member is a hanger operable to hold a clothing item, the hanger having a hook disposed between two extending arms, the main arm extending below the extending arms, opposite the hook.

14. A method for concealing and storing a long gun and a pistol, comprising:

hanging a storage assembly by a hanging member, the storage assembly including:

clothing hanging arms extending from opposite sides of the hanging member;

a main arm having a plurality of holes formed therethrough, each of the plurality of holes extending entirely through the main arm, providing passage from a front side of the main arm to a back side of the main arm, and the main arm extending downward, opposite the hanging member;

an extension arm, having a plurality of extension arm holes, telescopingly extendable from an open bottom end of the main arm, the extension arm having a proximate end insertable into the open bottom end of the main arm and a distal end extending out of the open bottom end;

an upper securing device adjustably positioned along a length of the main arm and extending from a front side of the main arm, the upper securing device operable to retain a barrel end of the long gun;

a lower base member disposed at the distal end of the extension arm and extending from a front side of the extension arm, the lower base member operable to permit a stock of the long gun to rest thereupon; and a pistol holder attached on at least one of the main arm or the extension arm, the pistol holder operable to secure a pistol thereto in a position behind a rear surface of the main arm or the extension arm;

placing a barrel of the long gun into the upper securing device;

resting a stock of the long gun on the lower base member;

placing a pistol in the pistol holder; and placing a clothing item on the clothing hanging arms to at least partially conceal the long gun and the pistol, wherein the pistol holder includes an elongated post extending from a base of the pistol holder, the elongated post operable to fit into a barrel of a pistol; and the pistol holder is angled so that when the barrel of the pistol is fit onto the elongated post, the pistol extends, from a distal end of the barrel, toward the main arm and at least a portion of the pistol is positioned adjacent and behind the rear surface of the main arm.

15. The method of claim 14, wherein the lower base member is formed as an open pocket having a base member, sides extending upward from the base member, and an open top end, and the stock fits within the sides of the lower base member.

* * * * *